US011604047B2

(12) United States Patent
Chirila

(10) Patent No.: US 11,604,047 B2
(45) Date of Patent: Mar. 14, 2023

(54) ELECTRIC SHOCK SELF-DEFENCE CARTRIDGE AND DEVICE

(71) Applicant: Mircea Chirila, Alovera (ES)

(72) Inventor: Mircea Chirila, Alovera (ES)

( * ) Notice: Subject to any disclaimer, the term of this patent is extended or adjusted under 35 U.S.C. 154(b) by 0 days.

(21) Appl. No.: 17/825,589

(22) Filed: May 26, 2022

(65) Prior Publication Data

US 2022/0290947 A1 Sep. 15, 2022

Related U.S. Application Data

(63) Continuation of application No. 17/350,622, filed on Jun. 17, 2021, now Pat. No. 11,371,811, which is a continuation of application No. PCT/ES2019/070872, filed on Dec. 20, 2019.

(30) Foreign Application Priority Data

Dec. 27, 2018 (ES) ..... ES201800280

(51) Int. Cl.
*F41H 13/00* (2006.01)

(52) U.S. Cl.
CPC ..... *F41H 13/0025* (2013.01)

(58) Field of Classification Search
CPC ..... F41H 13/0025
See application file for complete search history.

(56) References Cited

U.S. PATENT DOCUMENTS

| | | | | |
|---|---|---|---|---|
| 4,719,534 | A | 1/1988 | Ward | |
| 5,467,247 | A | 11/1995 | De Anda | |
| 5,786,546 | A | 7/1998 | Simson | |
| 11,371,811 | B2 * | 6/2022 | Chirila | F41H 13/0018 |

FOREIGN PATENT DOCUMENTS

| | | | |
|---|---|---|---|
| RU | 2015147495 | A | 5/2017 |
| RU | 2706796 | C2 | 11/2019 |

OTHER PUBLICATIONS

International Search Report and Written Opinion received in international application No. PCT/ES2019/070872, dated May 12, 2020 (14 pages).

* cited by examiner

*Primary Examiner* — Reginald S Tillman, Jr.
(74) *Attorney, Agent, or Firm* — Edell, Shapiro & Finnan, LLC

(57) ABSTRACT

According to one embodiment an electric shock self-defence cartridge is provided that includes a distal body in which one or more application means is housed, and a proximal body in which a wire is housed. The proximal body includes coupling means and electric connection means for being joined with the electric shock self-defence device. Compression means is arranged between the distal body and the proximal body for keeping the distal body shifted towards a rest position. The application means is housed in the distal body, such that in use, when the distal body is in contact with an assailant, the distal body shifts with respect to the proximal body from the rest position towards an actuation position in which the application means projects from the distal body to be adhered to the assailant's body.

17 Claims, 9 Drawing Sheets

ELECTRIC SHOCK SELF-DEFENCE CARTRIDGE AND DEVICE

CROSS-REFERENCE TO RELATED APPLICATIONS

This application is a continuation of application Ser. No. 17/350,622, filed Jun. 17, 2021, which relates to and claims the benefit and priority to International Application No. PCT/ES2019/070872, filed Dec. 20, 2019, which claims the benefit and priority to Spanish Patent Application No. P201800280, filed Dec. 27, 2018.

TECHNICAL FIELD

The present invention relates to the field of self-defence equipment and more specifically to the field of electric shock self-defence devices.

The present invention relates to a cartridge applicable by contact for a self-defence device of electric shock sustained over time, providing and ensuring an effective and efficient way to repel, neutralize or subdue a potential assailant.

BACKGROUND

Electric shock self-defence devices are designed to work by means of using an electric device provided, among other elements, with an electric charge accumulator and an amplifier of the voltage produced by an electric shock which incapacitates the locomotor system of the assailant, thus enabling to neutralize or mitigate the effects of a violent attack, conferring a self-defence and reaction capacity to the potential victim who uses it.

These devices include those which work by the short-distance shooting of electric darts and others which work by direct contact with the electric poles of the device.

Among the devices which work by direct contact, those commonly referred to as stun guns can be named, which with a diverse form of presentation: rectangular, curved, baton type, flashlight type, mobile telephone type, ring type, etc.; and with a different electric shock capacity, all have the feature of working on the potential assailant exclusively by direct contact and for the strict time that the electric poles touch the assailant's body.

Among the devices which work by distance shooting, those of the Taser® brand, among others, can be named, which use an electric device in the form of a gun, to which a cartridge provided with two darts is applied, which darts are shot towards the assailant's body, driven by a compressed gas discharge, such that a conducting wire joins the darts with the electric shock device.

See for example document US20030106415A1, which shows an electric shock self-defence device in the form of a gun having an exchangeable cartridge. The cartridge comprises application means in the form of darts configured to be adhered to assailant's body and wires electrically connecting the application means with the electric shock self-defence device.

SUMMARY

Disclosed are cartridge and an electric shock self-defence devices for applying incapacitating electric shocks to an assailant.

One aspect of the invention relates to a cartridge for an electric shock self-defence device comprising application means configured to be adhered to the assailant's body and at least one wire electrically connecting the application means with the electric shock self-defence device. The cartridge comprises a distal body in which the application means are housed, a proximal body in which the wire is housed and having coupling means and electrical connection means for being mechanically and electrically joined with the electric shock self-defence device, and compression means which are arranged between the distal body and the proximal body to keep the distal body shifted with respect to the proximal body in a rest position in which the application means are housed in the distal body, such that in use, the distal body being in contact with the assailant, the distal body is shiftable with respect to the proximal body from the rest position towards an actuation position in which the application means project from the distal body to be adhered to the assailant's body.

Another aspect of the invention relates to an electric shock self-defence device comprising at least one cartridge such as the one described above.

The use of the self-defence device, firstly, comprises applying kinetic energy to the device by displacing it towards the assailant, making the distal body of the cartridge come into contact with the assailant's body. Thus, the distal body shifts from the rest position towards the actuation position, in which the application means are adhered to the assailant's body, and secondly, the use of the device comprises moving away from the assailant together with the device, the application means remaining adhered to the assailant's body and the electrical connection of the application means being maintained through the wire.

The main advantages of the invention are summarized below:

- Since shiftable bodies which act by contact with the assailant are used, the application of the application means in the selected target is achieved in an effective and accurate manner, the risks of missing due to lack of aim, which occur in Taser® type distance shooting devices, being reduced.
- Since the application means are adhered to the assailant's body, a prolonged and continuous shock is achieved, thus resolving the usual problems of inefficiency which occur in the devices working by direct contact, the effectiveness of which is merely sporadic and only for the strict lapse of time in which the electric poles are in contact with the assailant's body.
- The use of the wire joined to the application means allows the application of incapacitating electric shocks, from a prudential distance.
- Since the application means are housed in the distal body in the rest position, accidental electric shocks are prevented, such as those which may occur by using devices working by direct contact, wherein the electric poles are exposed.

These and other advantages and features of the invention will become evident in view of the figures and of the detailed description of the invention.

BRIEF DESCRIPTION OF THE DRAWINGS

FIG. 10 shows another embodiment for the reiterated application of the application means in the form of adherent electrodes, said embodiment being applicable to any one of the devices shown in FIGS. 1 to 4.

DETAILED DESCRIPTION

Figure 1:
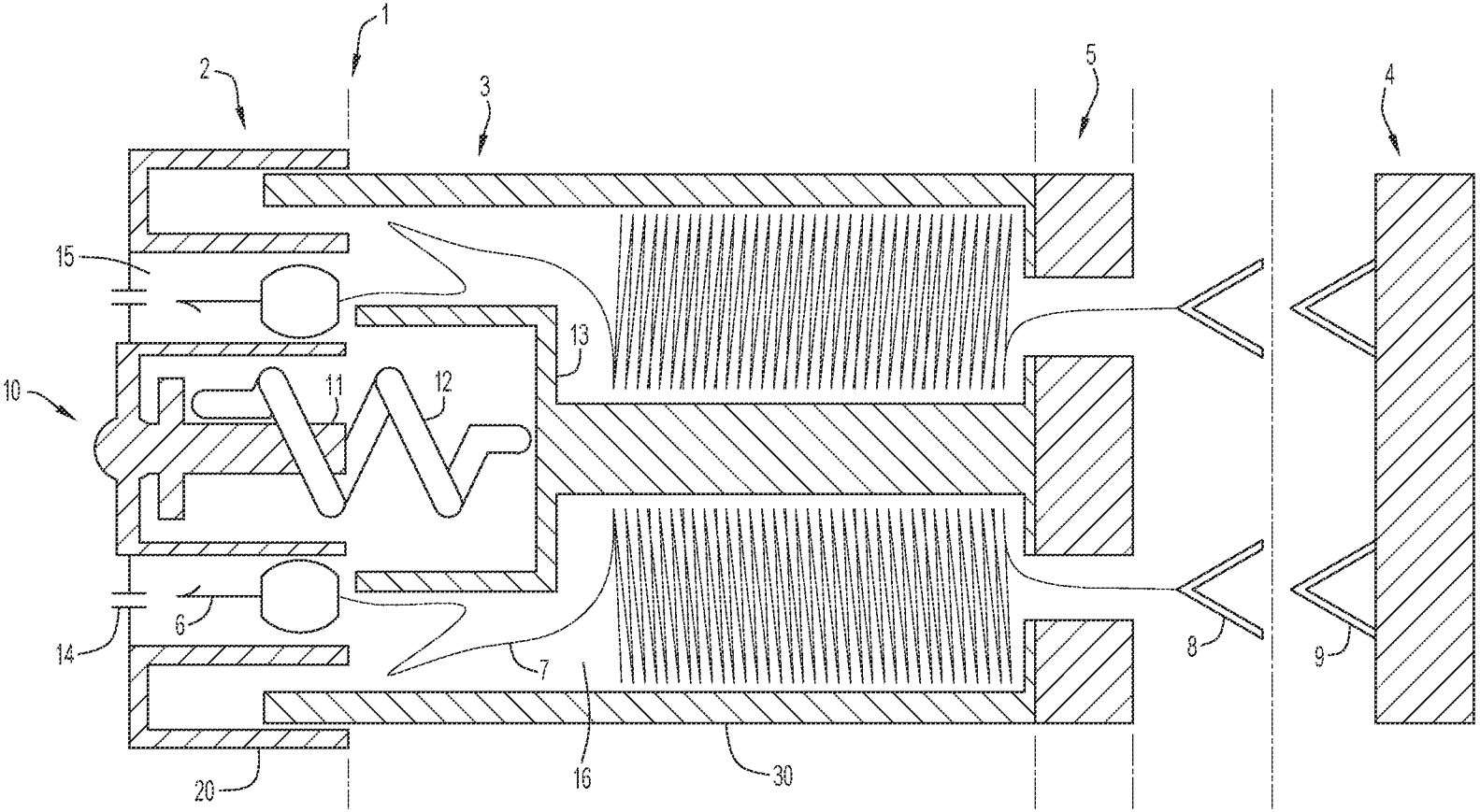
FIG. 1 shows a schematic upper plan view of a first embodiment of the device of the invention in the rest position.

The electric shock self-defence electronic device 4 comprises at least one cartridge 1 which is a unitary functional structure which can be assembled and disassembled with respect to the body of the electric shock device 4. The cartridge 1 has application means 6 configured to be adhered to the assailant's body and at least one wire 7 electrically connecting the application means 6 with the electric shock device 4.

The cartridge 1 comprises a distal body 2 and a proximal body 3 shiftable to one another. The distal body 2 has a front casing 20 with at least one conduit 15 for housing the application means 6 and at least one outlet 14 for the passage of the application means 6, the application means 6 being housed in the conduit 15 and oriented in the direction to the outlet 14. The proximal body 3 has a rear casing 30 with at least one container 16 for storing the wire 7 in a wound form, and coupling means 5 and electrical connection means 8 for being mechanically and electrically joined with the electric shock device 4. The wire 7 is of an electric conductor material and is arranged wound inside the proximal body 3 such that it can be extended.

Between the distal body 2 and the proximal body 3 there are arranged compression means 10 for keeping the distal body 2 shifted with respect to the proximal body 3 in a rest position in which the application means 6 are housed in the distal body 2, such that in use, the distal body 2 being in contact with the assailant, the distal body 2 is shiftable with respect to the proximal body 3 from the rest position towards an actuation position in which the application means 6 project from the distal body 2 to be adhered to the assailant's body.

The electric shock device 4 has electric means (not depicted), such as high-voltage battery, for electrically powering the application means 6 through the wire 7. The electric shocks are activated through controls (not depicted) which the device 4 has.

The application means 6 can be puncture application means configured to pass through the clothes and be housed in the assailant's body. The puncture application means are manufactured in an electricity conducting material and can be needles 6 in the form of a harpoon, or a hook, or a staple, as depicted in FIGS. 1 to 4, as well as in FIGS. 12 and 13. Alternatively, the application means 6 can be an adherence application means formed by adherent electrodes 6 which increase the surface of contact by adherence for the purposes of applying the incapacitating shocks, as shown in FIG. 14.

By way of a non-limiting example, the compression means 10 can be a longitudinal compression spring 12 (see FIGS. 1, 2 and 9), a side compression spring 12 (see FIGS. 3, 5 and 6), or where appropriate, a compression material 19 in plastic or elastic deformation mode (see FIG. 4), such as a ballistic gel for example.

The coupling means 5 and electrical connection means 8 are arranged in the proximal body 3 of the cartridge 1 at an end opposite to the end at which the proximal body 3 is joined in a shiftable manner with the distal body 2. The electrical connection means 8 is joined to the wire 7 and is configured to be connected with an electric pole 9 of the electric shock device 4. The coupling means 5 which allow assembling and disassembling the cartridge 1 with respect to the device 4 is presented such that it allows adapting the cartridge 1 to the features of the different types and modes of electric devices 4, to confer the optimal mode of use of the device 4. In an exemplifying and non-limiting manner, the coupling means 5 can be rails.

The cartridge 1 additionally comprises drive means 21 for driving the application means 6 and adhering them to the assailant (see FIGS. 5 to 8). The drive means 21 is operatively connected to a trigger 22 operating the drive means 21 when the distal body 2 shifts from the rest position towards the actuation position. Thus, when the distal body 2 makes contact with the assailant's body and passes from the rest position towards the actuation position, the distal body 2 activates the trigger 22 which in turn activates the drive means 21 to push the application means 6, increasing the force with which the application means 6 are adhered to the assailant's body.

The outlet 14 is an openable door which is blocked in the rest position and open in the actuation position by the action of the application means 6, such that in the rest position the application means 6 is housed inside the conduit 15 of the distal body 2 in an aseptic medium, minimizing the risk of being self-electrocuted due to misusing the device.

The basic steps of a process for using the electric shock device 4 are described below, which process comprises the following steps:

- assembling the cartridge 1 in the electric shock device 4;
- pre-activating the electric shock device 4, preparing it for carrying out the electric shocks;
- applying a sufficient kinetic energy in the electric shock device 4 such that it is driven towards the assailant's body for the purpose of applying the application means 6; and
- operating a switch of the controls of the electric shock device 4 to carry out the incapacitating high voltage controlled electric shocks.

Figure 2:
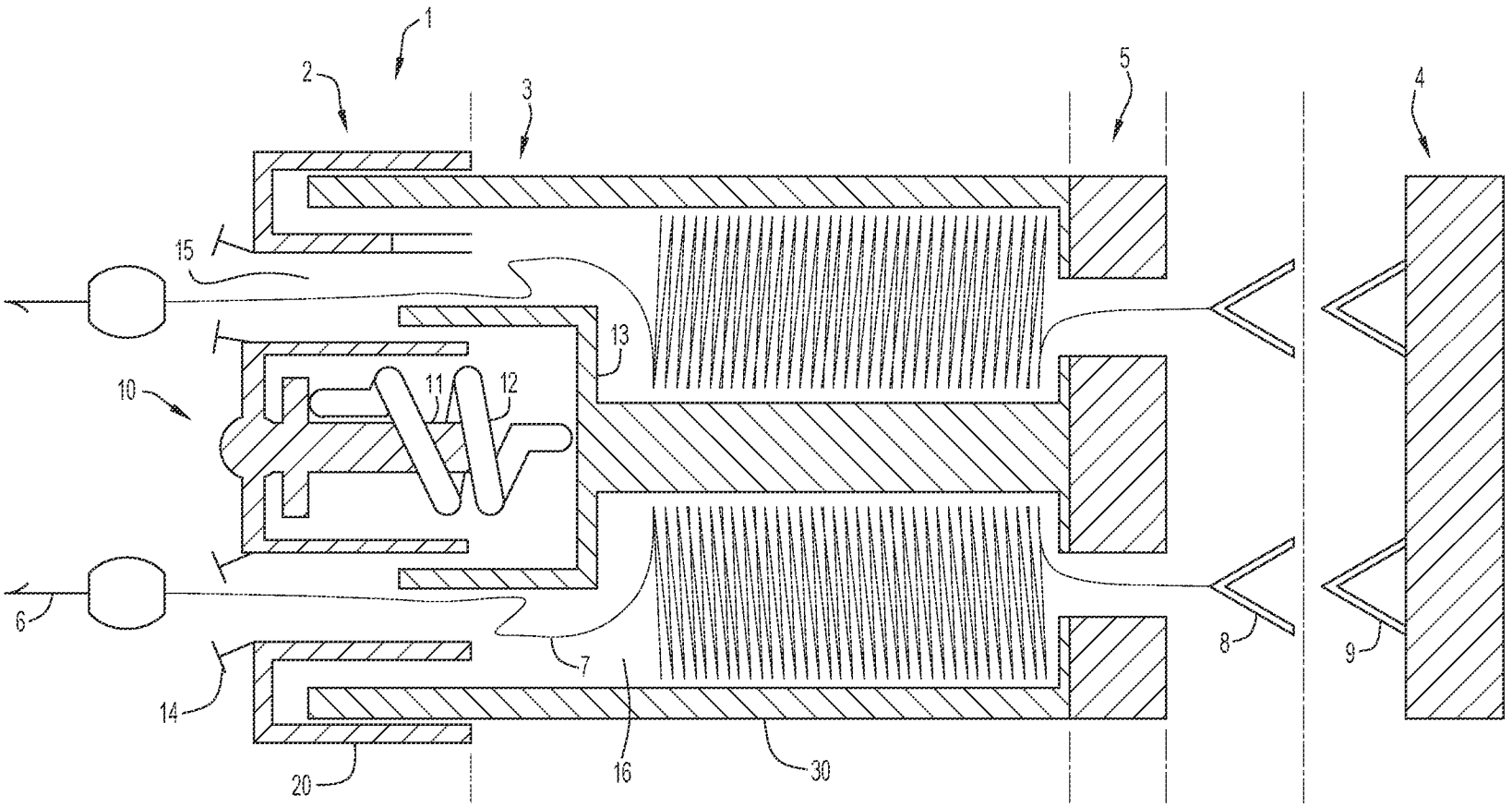
FIG. 2 shows a schematic upper plan view of the device of FIG. 1 in the actuation position.

FIGS. 1 and 2 show a first embodiment of the electric shock device 4. FIG. 1 shows the cartridge 1 in the rest position and FIG. 2 shows the cartridge 1 in the actuation position. The cartridge 1 has the distal body 2 with the application means 6 housed in the conduits 15 communicating with the outlets 14, and the proximal body 3 with the wires 7 housed in a wound manner in the storages 16. The application means 6 are needles 6 having an end with an edge in the form of a harpoon and another end with a blunt shape which is supported against a part of the proximal body 3. The compression means 10 comprise a longitudinal spring 12 arranged between the front casing 20 of the distal body 2 and a compression stop 13 of the proximal body 3, the longitudinal spring 12 being guided by means of a bolt 11 with a compression plate, and the compression stop 13 being fork-shaped with two rods for the support of the end with a blunt shape of two respective needles 6 which are arranged on each side of the compression means 10 in two respective conduits 15. The longitudinal spring 12 works under compression and is configured to keep the distal body 2 in the rest position with respect to the proximal body 3. Each of the wires 7 is joined to an electrical connection means 8 for establishing a detachable electrical coupling with a respective electrical pole 9 of the electric shock device 4.

Thus, as observed in FIG. 2, the distal body 2 shifts by sliding towards the proximal body 3 in a determined distance range, overcoming the force exerted by the longitudinal spring 12 and releasing the needles 6 which pass through the outlets 14 and are applied in the assailant's body. The device can be removed by allowing the wires 7 to follow the needles 6 and be extended without obstructions from the storage container 16 located in the proximal body 3, allowing immediately afterwards carrying out the controlled and continuous shocks, with an incapacitating effect. After carrying out the shocks, the cartridge 1 can be uncoupled and, where appropriate, replaced with another one, by means of rails, or similar elements, which serve as a coupling means 5 with the device 4.

Figure 3:
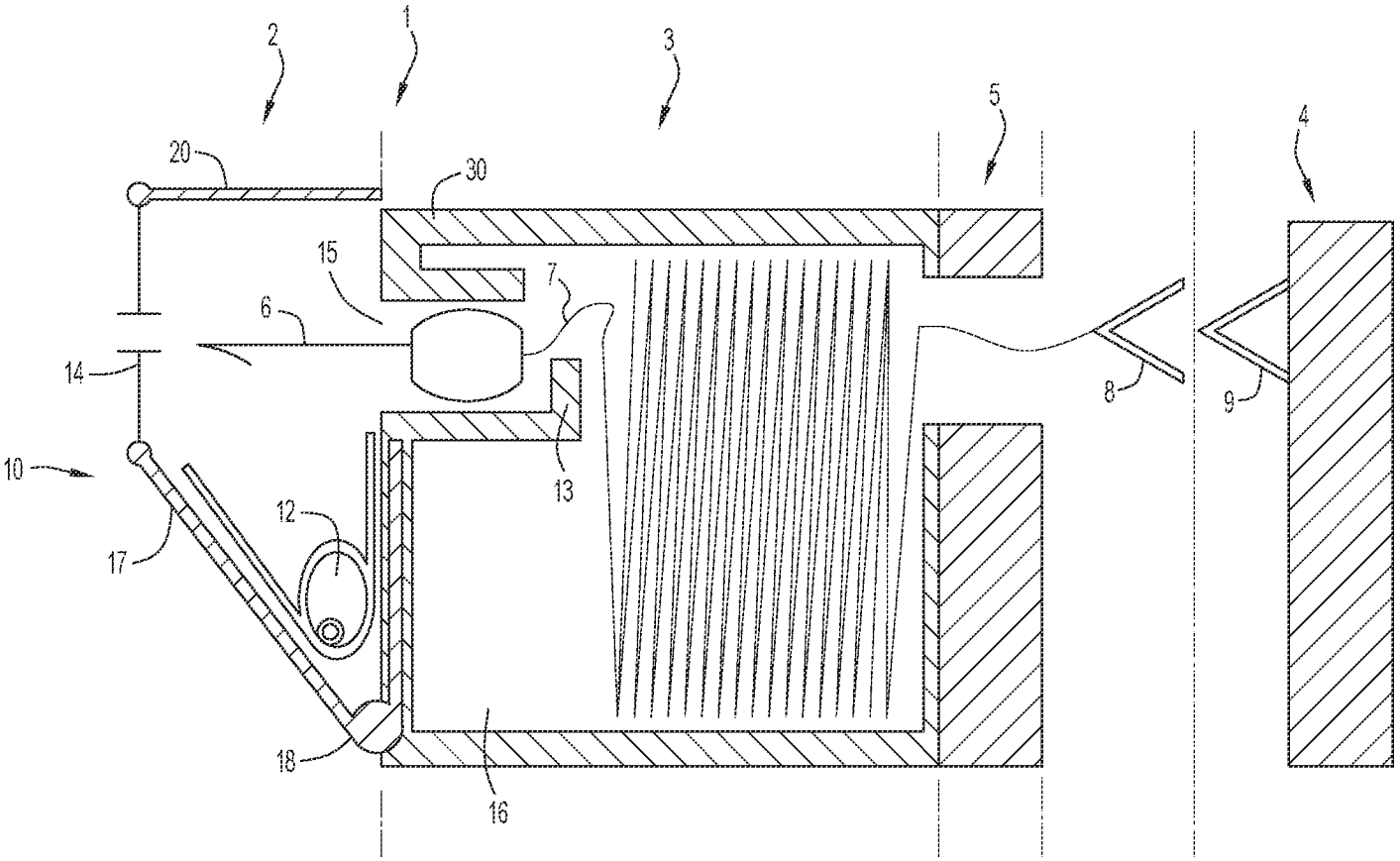
FIG. 3 shows a schematic side plan view of a second embodiment of the cartridge in the rest position.

FIG. 3 shows a second embodiment of the electric shock device 4 with the cartridge 1 in the rest position. The cartridge 1 has the distal body 2 with the application means 6 housed in the conduit 15 communicating with the outlet 14, and the proximal body 3 with the wire 7 housed in a wound form in the container 16. The application means 6 is a needle 6 having an end with an edge in the form of a harpoon and another end with a blunt shape which is supported against a part of the proximal body 3. The compression means 10 comprise a hinge 18 with a fixed plane integral with the proximal body 3 and a mobile plane formed by a side compression plate 17 integral with the distal body 2, a side compression spring 12 being arranged in the inner angle of the hinge 18. The side compression spring 12 acts by conferring a determined resistance force with respect to the compression plate 17, keeping the distal body 2 in the rest position with respect to the proximal body 3, and serving as an insurance against involuntary applications. The proximal body 3 defines a stop 13 for the support of the end with a blunt shape of the needle 6 which is arranged on one side of the compression means 10 in a conduit 15. The wire 7 is joined to an electrical connection means 8 to establish a detachable electric coupling with an electric pole 9 of the electric shock device 4.

The operation of the second embodiment is analogous to the one described above for the first embodiment. When the cartridge 1 makes contact with the assailant, the distal body 2 shifts by sliding towards the proximal body 3 in a determined distance range, overcoming the force exerted by the side compression spring 12 and releasing the needle 6 which passes through the outlet 14 and is applied in the assailant's body.

Figure 4:
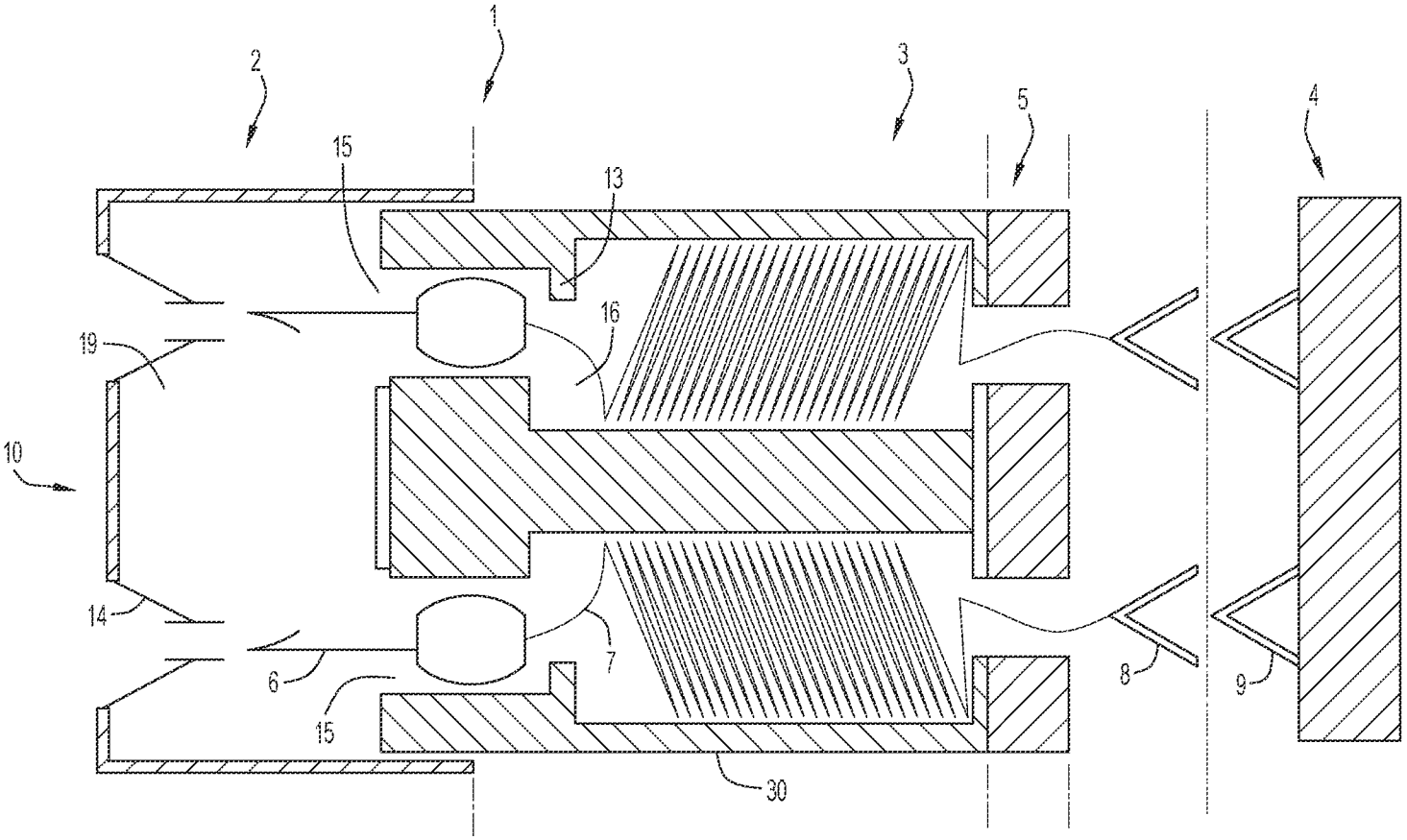
FIG. 4 shows a schematic upper plan view of a third embodiment of the cartridge in the rest position.

FIG. 4 shows a third embodiment of the electric shock device 4 with the cartridge 1 in the rest position. The cartridge 1 has the distal body 2 with the application means 6 housed in the conduits 15 communicating with the outlets 14, and the proximal body 3 with the wires 7 housed in a wound form in the containers 16. The application means 6 are needles 6 having an end with an edge in the form of a harpoon and another end with a blunt shape which is supported against a part of the proximal body 3. The compression means 10 comprise an elastic or plastic deformation material 19 which is arranged inside the distal body 2. The material 19 is arranged inside the distal body 2 except for the conduits 15 allowing the passage of the needles 6 together with the wires 7. The material 19 works under compression and is configured to keep the distal body 2 in the rest position with respect to the proximal body 3. Alternatively, all the distal body 2 can be made in the elastic or plastic deformation material 19. When the material 19 has a plastic deformation, it does not recover its shape and when the material has an elastic deformation it can recover its shape by shifting again the distal body 2 from the actuation position to the rest position. For example, the material 19 can be a ballistic gel. Each of the wires 7 is joined to an electrical connection means 8 to establish a detachable electric coupling with a respective electric pole 9 of the electric shock device 4.

The operation of the third embodiment is analogous to the one described above for the first embodiment. When the cartridge 1 makes contact with the assailant, the distal body 2 shifts by sliding towards the proximal body 3 in a determined distance range, overcoming the force exerted by the elastic or plastic deformation material 19 and releasing the needles 6 which pass through the outlets 14 and are applied in the assailant's body.

FIGS. 1 to 4 depict the application means 6 as puncture application means in the form of needles 6 having an edge in the form of a harpoon, although they could be needles with an edge in the form of a hook or a staple, or adherent electrodes. Thus, in the case of using puncture application means, the needles 6 have an end with an edge in the form of a harpoon, or hook, or staple, and another end with a blunt shape which is supported against a part of the proximal body 3.

FIGS. 5 to 8 show four embodiments of the drive means 21 which push the application means 6 in the direction towards the outlet 14 of the distal body 2, improving and ensuring the adherence of the application means 6 in the assailant's body. The examples of FIGS. 5 to 8 are shown schematically and can be applicable to any one of the embodiments depicted in FIGS. 1, 3 and 4.

The drive means 21 push the application means 6 in the direction towards the outlet 14 of the distal body 2, improving and ensuring the adherence of the application means 6 in the assailant's body. The drive means 21 can be a bottle of air or of compressed gas (see FIG. 5), or a mechanical spring (see FIG. 6), which is arranged in the proximal body 3 and which drives by contact the application means 6 towards the outlet 14 of the distal body 2 of the cartridge 1. Alternatively, the drive means 21 can be an external force (depicted by an arrow in FIG. 7), such as a stream of compressed air or gas, coming from the electric shock device 4, for which the electric shock device 4 is in fluid communication with the distal body 2 and proximal body 3 by means of a channel 23 communicating the conduit 15 wherein the application means 6 is located with a compressed air or gas source which is arranged in the electric shock device 4.

Figure 5:
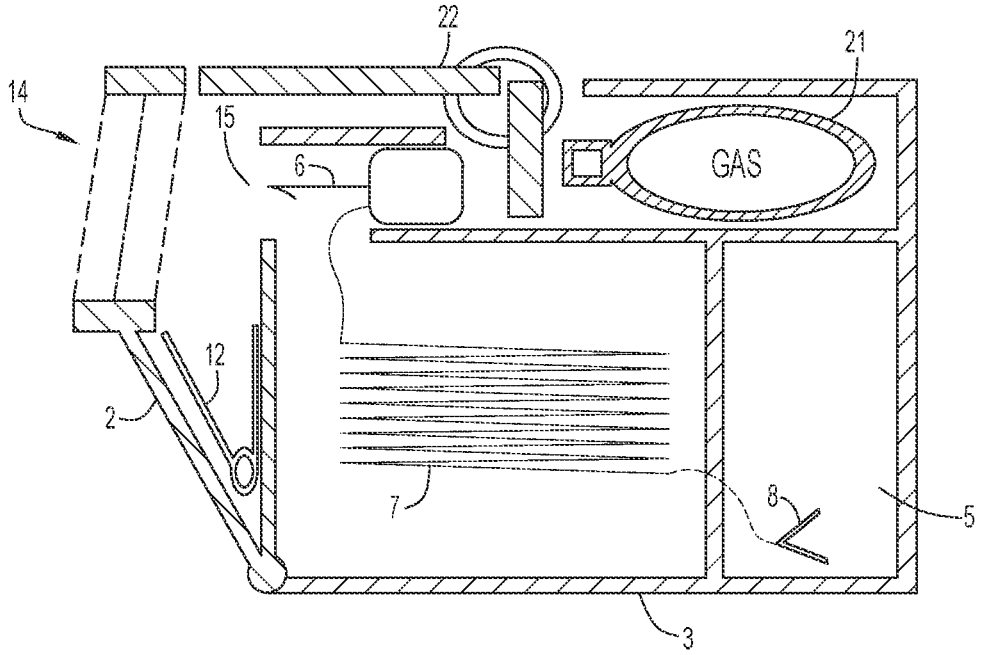
FIGS. 5 to 8 show four embodiments of cartridges with drive means for driving the application means towards the exit of the distal body, the drive means being applicable to any one of the devices shown in FIGS. 1 to 4.
Figure 6:
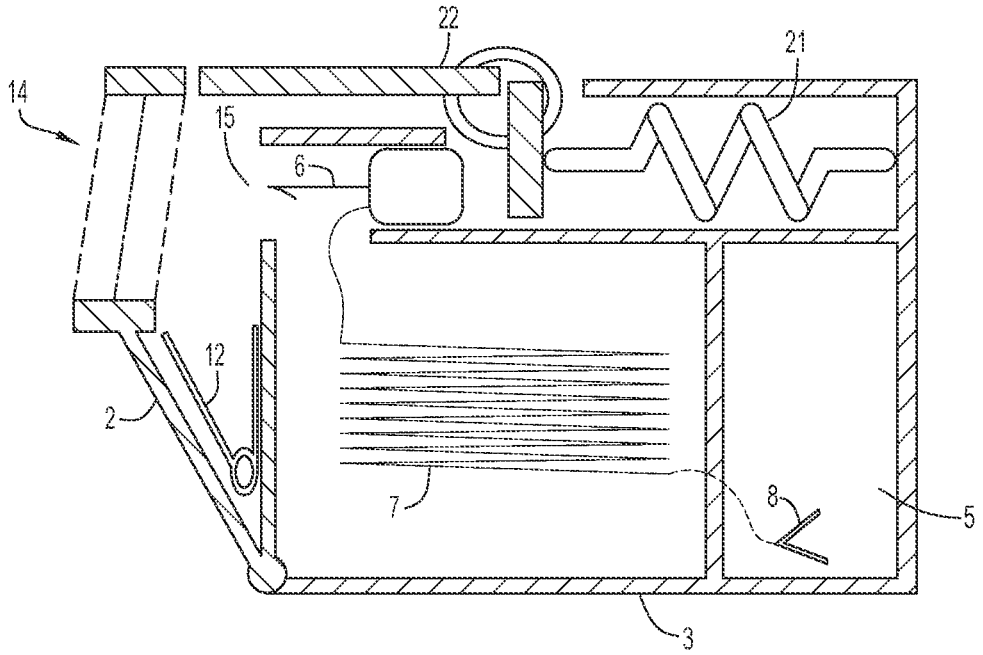

In FIGS. 5 and 6 the trigger 22 is arranged between the distal body 2 and the proximal body 3, the trigger 22 being able to be actuated by the distal body 2, such that when the distal body 2 shifts from the rest position towards the actuation position by contact with the assailant, the distal body 2 makes contact with the trigger 22, operating the drive means 21 which operate the application means 6. FIGS. 5 and 6 show a distal body 2 with a side compression spring 12 like in FIG. 3, although said embodiments could be applied to one of the cartridges of FIGS. 1 and 4.

Figure 7:
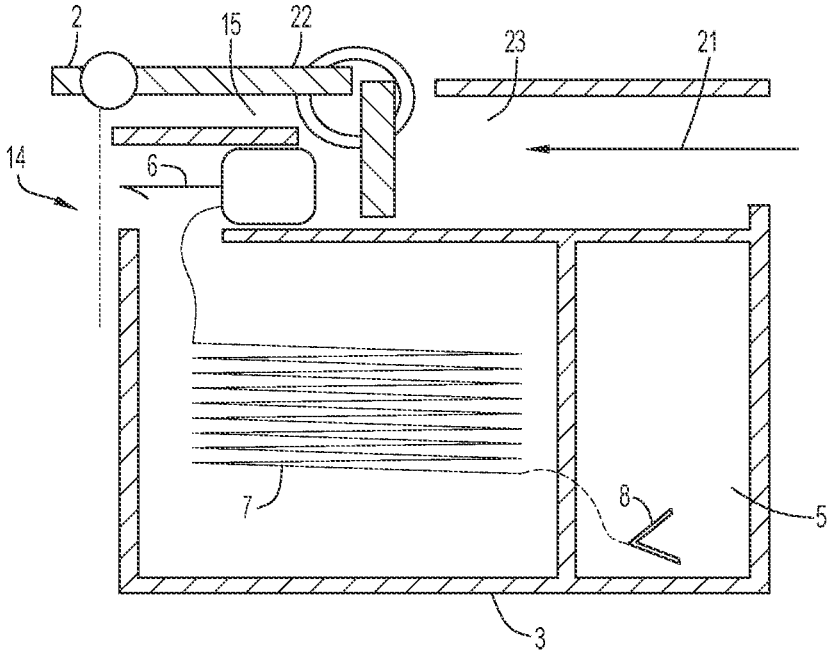
Figure 8:
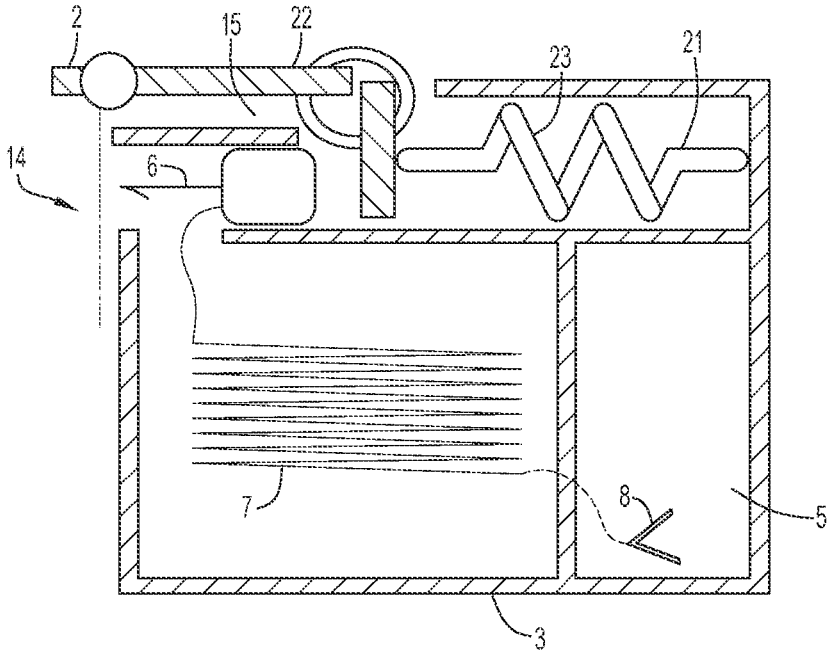

In FIGS. 7 and 8 the trigger 22 is the distal body 2, such that when the trigger 22 shifts from the rest position towards the actuation position by contact with the assailant, the trigger 22 operates the drive means 21 which operate the application means 6.

The outlet 14 of FIGS. 5 to 8 can be an openable door, or a protective film, which is blocked in the rest position and open in the actuation position by the action of the application means 6. Alternatively, the outlet 14 of FIGS. 5 to 8 can be an openable door, or a protective film, an end of the trigger 22 being operatively connected with the outlet 14, such that the outlet 14 is openable by the shift of the trigger 22 when the distal body 2 shifts from the rest position towards the actuation position. Thus, as depicted in the example of FIGS. 5 and 6, the outlet 14 is opened automatically and prior to the contact with the application means 6, by the actuation of the trigger 22, which actuates internally on the outlet 14, taking the outlet 14 towards the proximal body 3, and therefore opening the outlet 14 for the passage of the application means 6 and the wires 7, without obstructions. In addition, as depicted in the example of FIGS. 7 and 8, the outlet 14 is a protective film with an anchoring point in the proximal body 3 and another anchoring point in an end of the trigger 22. Thus, the film 14 is opened prior to the contact with the application means 6, by the tension applied by the shift of the trigger 22 which breaks the protective film 14 at the height of the application means 6.

The electric shock device 4 can have a cartridge 1 with several application means 6 for a reiterated application of the application means 6. Since several application means 6 are used, the reiterated application is allowed, which increases the incapacitating effect on the assailant, because the body/muscular surface for the application of the electric chicks can be increased.

Figure 9:
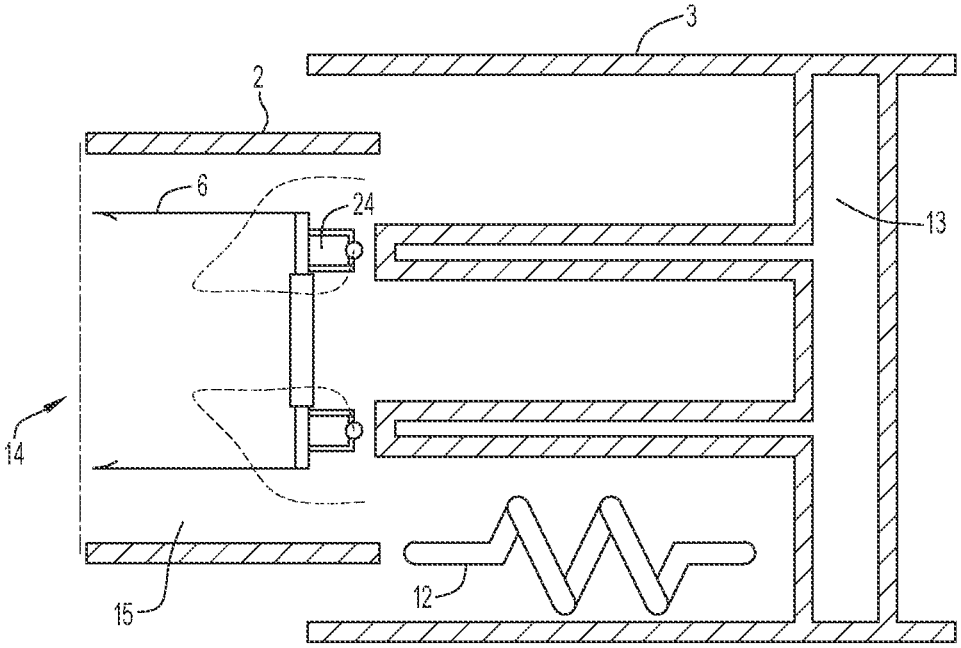
FIGS. 9 and 10 show an embodiment of a mechanism for the reiterated application of the application means, said embodiment being applicable to any one of the devices shown in FIGS. 1 to 4.
Figure 10:
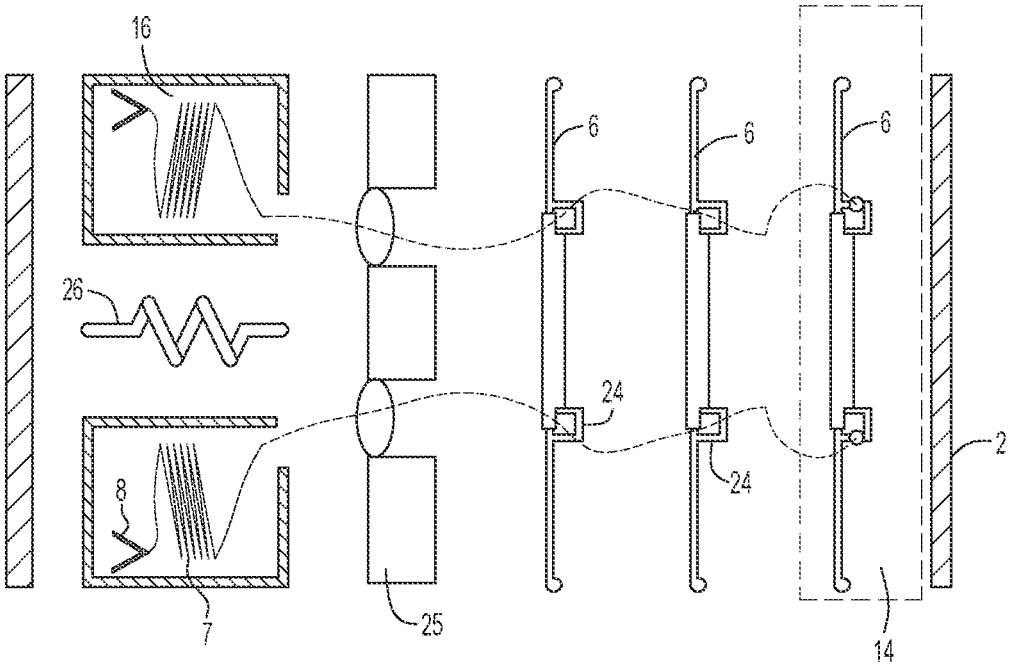

FIGS. 9 and 10 show an embodiment of a mechanism for the reiterated application of several needle type application means 6, said embodiment being applicable to any one of the embodiments depicted in FIGS. 1, 3 and 4.

As shown in the front view of FIG. 9, the needles 6 are arranged in the distal body 2 forming a transverse stack, and the mechanism for the reiterated application of the needles 6 comprises a compression plate 25 actuated by a spring 26 which gradually shifts the needles 6 in a transverse direction in order to align them with the outlet 14 of the distal body 2, similarly to the operation of a stapler. Thus, firstly the distal body 2 shifts from the rest position towards the actuation position to apply one of the needles 6 of the transverse stack, wherein the force of the spring 12 is overcome and the needle 6 makes contact with the compression stop 13 (see FIG. 9), and next, when the distal body 2 returns to the rest position by the action of the spring 12, the compression plate 25 shifts a step in order to align the next needle 6 of the transverse stack with the outlet 14 of the distal body 2, such that the application of said next needle 6 is shut allowed in new shift of the distal body 2. FIGS. 9 and 10 show that the several needles 6 have deformable handles 24 of electric conductor material which allow the passage of the wires 7 to join the needles 6 to one another. Thus, every time a needle 6 is stacked, as has been described above, the deformable handle 24 is deformed against the compression stop 13, fixing the wire 7 to the needle 6, it being possible to apply in a reiterated and successive manner the rest of the needles 6 in the assailant's body.

Figure 11:
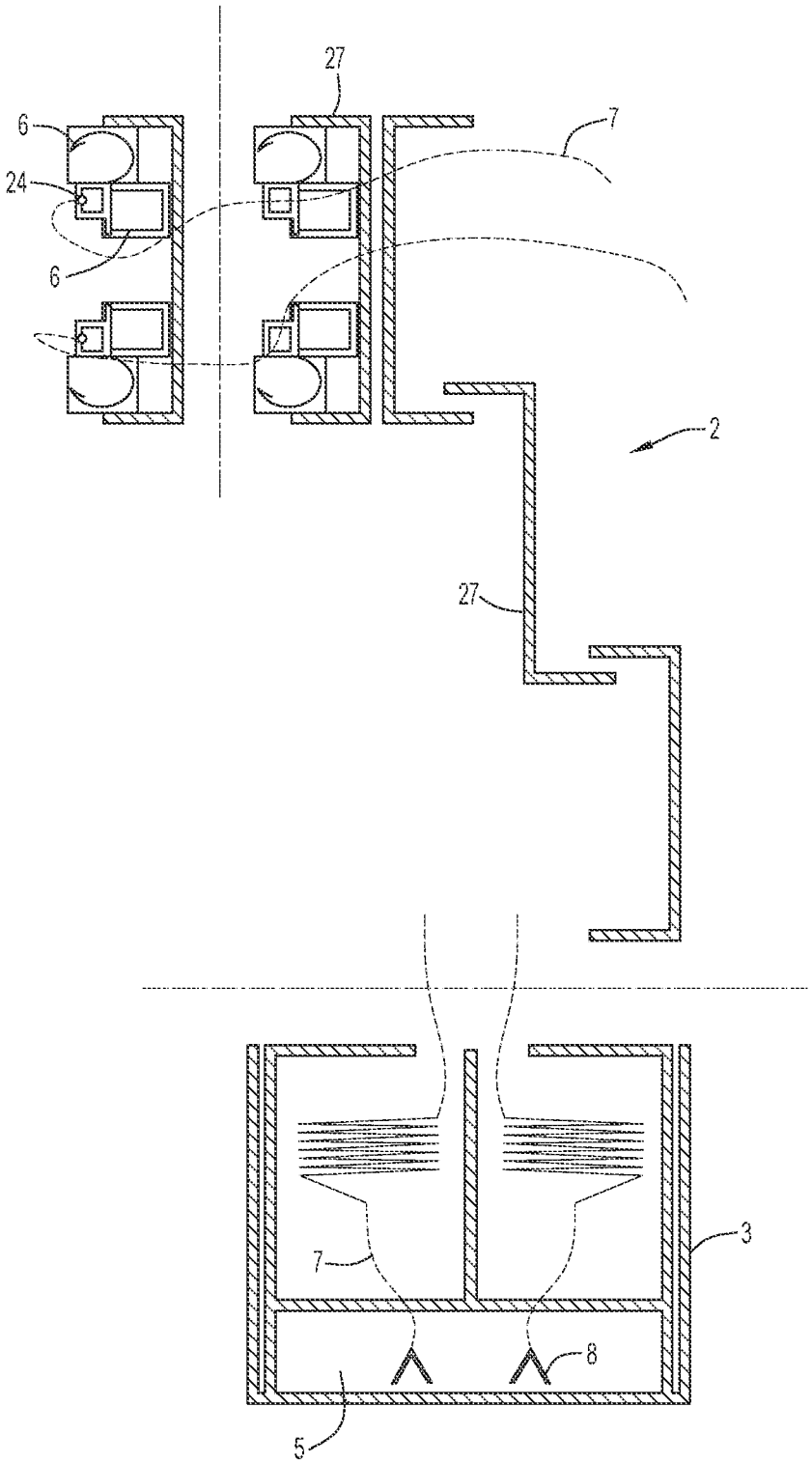
FIG. 11 shows another embodiment for the reiterated application of the application means, with a distal body in the form of a lance.

FIG. 11 shows another embodiment of a cartridge 1 for the reiterated application of several application means 6. The cartridge 1 comprises a distal body 2 having application means 6 configured to be adhered to an assailant's body, and a proximal body 3 having wires 7 electrically connecting the application means 6 with an electric shock self-defence device 4. The distal body 2 is a lance which is connected at one of its ends with the proximal body 3, the lance being formed by segments 27 linked to one another, and the application means 6 being arranged in the segments 27. The application means 6 can be located in any plane of any of the segments 27. The proximal body 3 has containers 16 for storing the wires 7, and has coupling means 5 and electrical connection means 8 for being mechanically and electrically joined with the electric shock self-defence device 4. The lance can be elongated and/or extensible and/or flexible.

The cartridge 1 is applied upon being handled by the actuator from the proximal body 3, and is driven by kinetic energy, towards the assailant, with the range allowed by the length of the lance and with the appropriate effect depending on the application means provided in the segments 27 and on their location in the different planes of the lance, whether these application means 6, exemplified in an illustrative and non-limiting manner, are puncture application means, hooks wrapped in ballistic gel, and/or adherent electrodes. The force of fixing of the application means 6 in the target is greater than the force of fitting of the segments 27 with one another, such that when the segment bearing the application means 6 which have been fixed in the assailant, are released from the lance, allowing the application of the application means 6 of the next segment of the lance.

As shown in FIG. 11, each segment 27 has two adherent electrodes 6 with a respective handle 24 for the passage and fixing of a wire 7, and two hooks 6 wrapped in ballistic gel. The adherent electrodes 6 are arranged in the middle part of the segment 27 and the hooks 6 with the ballistic gel are arranged at the ends of the segment 27, one at each end of the segment 27. When the segment 27 makes contact with the assailant's body, the handles 24 of the electrodes 6 are deformed against the assailant's body, fixing the wires 7 to the electrodes 6, whereas the electrodes 6 are adhered to the assailant's body. In addition, when the segment 27 makes contact with the assailant's body, the ballistic gel surrounding the hooks 6 is deformed, releasing the hook so that it sinks into the assailant's body.

Figure 12:
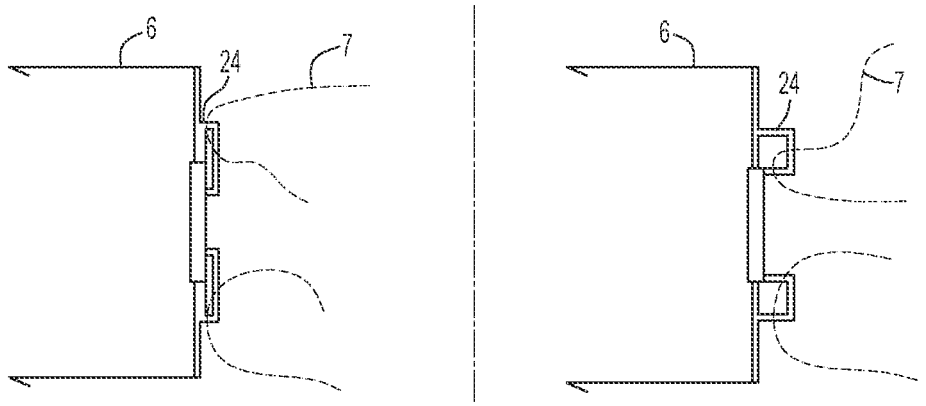
FIG. 12 shows needle type application means in the form of a staple for the reiterated application of the application means.
Figure 13:
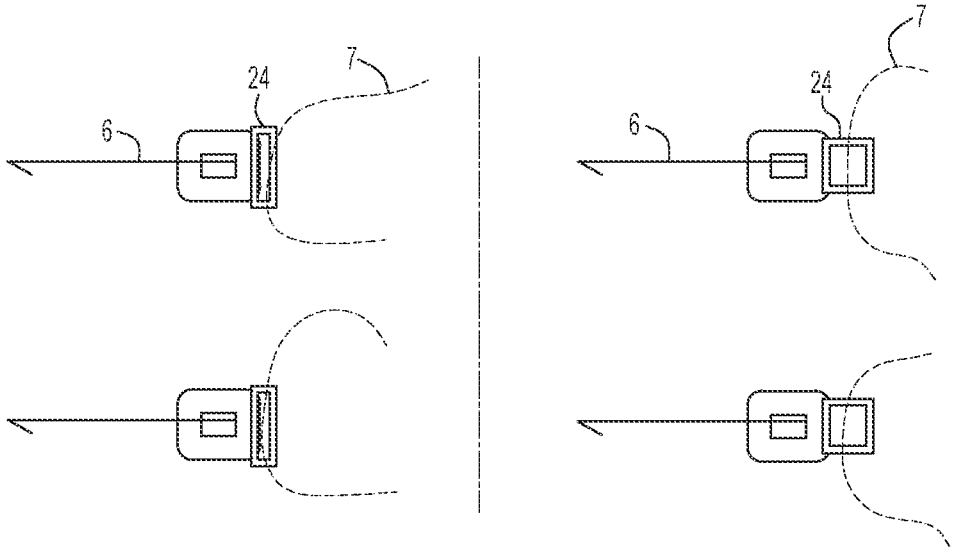
FIG. 13 shows needle type application means in the form of a harpoon for the reiterated application of the application means.
Figure 14:
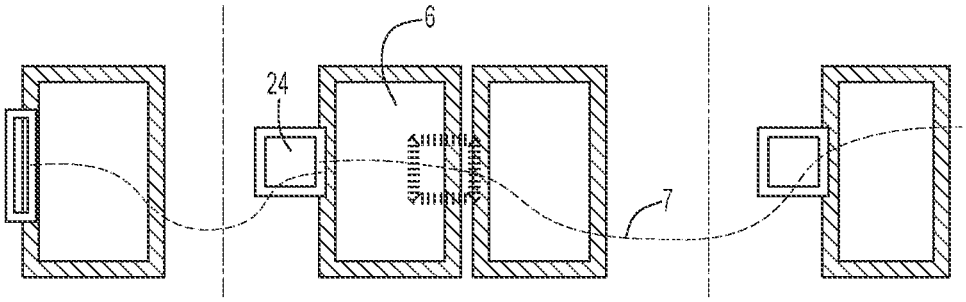
FIG. 14 shows application means in the form of adherent electrodes for the reiterated application of the application means.

FIGS. 12 and 13 show application means 6 in the form of a needle for allowing a reiterated application of the application means. FIG. 12 shows a needle 6 in the form of a staple having deformable handles 24 for the passage and fixing of the wires 7. In this case, the handles 24 are deformed when the compression stop 13 makes contact with the handle 24, deforming it and acting as a stop for the needle 6 to allow it to adhere to the assailant's body. FIG. 13 shows needles 6 in the form of a harpoon which also have deformable handles 24 for the passage and fixing of the wires 7. The operation of the harpoon is analogous to that of the staple.

FIG. 14 shows another embodiment for the reiterated application of the application means in the form of adherent electrodes 6, said embodiment being applicable to any one of the embodiments depicted in FIGS. 1, 3 and 4. In this case, the adherent electrodes 6 also have deformable handles 24 of electric conductor material which allow the passage of the wire 7 to join the electrodes 6 to one another. The electrodes 6 are fitted with one another, forming a longitudinal stack inside the distal body 2. Thus, every time an electrode 6 is stacked in the assailant's body, as has been described above in the first, second and third embodiments of FIGS. 1 to 4, the deformable handle 24 is deformed against the assailant's body, fixing the wire 7 to the electrode 6, it being possible to apply in a reiterated and successive manner the rest of the electrodes 6 in the assailant's body. FIG. 14 schematically depicts a longitudinal stack of three electrodes 6 which would be arranged in the distal body 2, and an electrode 6 in contact with the assailant's body with the deformed handle 24 which fixes the wire 7.

Embodiments of the cartridge and electric shock self-defence device are also disclosed in the following clauses.

Clause 1: A cartridge (1) for an electric shock self-defence device (4) used to apply incapacitating electric shocks in an assailant, the cartridge (1) comprising application means (6) configured to be adhered to the assailant's body and at least one wire (7) electrically connecting the application means (6) with the electric shock self-defence device (4), the cartridge (1) comprises a distal body (2) in which the application means (6) are housed, a proximal body (3) in which the wire (7) is housed and which has coupling means (5) and electrical connection means (8) for being mechanically and electrically joined with the electric shock self-defence device (4), and compression means (10) which are arranged between the distal body (2) and the proximal body (3) for keeping the distal body (2) shifted with respect to the proximal body (3) in a rest position in which the application means (6) are housed in the distal body (2), such that in use, the distal body (2) being in contact with the assailant, the distal body (2) is shiftable with respect to the proximal body (3) from the rest position towards an actuation position in which the application means (6) project from the distal body (2) to be adhered to the assailant's body.

Clause 2: The cartridge (1) according to the preceding clause, wherein the application means (6) are puncture application means.

Clause 3: The cartridge (1) according to the preceding clause, wherein the puncture application means are needles (6) in the form of a harpoon, or hook, or staple.

Clause 4: The cartridge (1) according to any of the preceding clauses, wherein the application means (6) are adherent electrodes.

Clause 5: The cartridge (1) according to any of the preceding clauses, additionally comprising drive means (21) for driving the application means (6) and adhering them to the assailant, wherein the drive means (21) are operatively connected to a trigger (22) operating the drive means (21) when the distal body (2) shifts from the rest position towards the actuation position.

Clause 6: The cartridge (1) according to any of the preceding clauses, wherein the distal body (2) has a front casing (20) with at least one conduit (15) for housing the application means (6) and at least one outlet (14) for the passage of the application means (6), the application means (6) being housed in the conduit (15) and oriented in the direction to the outlet (14), and wherein the proximal body (3) has a rear casing (30) with at least one container (16) for storing the wire (7) in a wound form.

Clause 7: The cartridge (1) according to the preceding clause, wherein the outlet (14) is an openable door, or a protective film, which is blocked in the rest position and open in the actuation position by the action of the application means (6).

Clause 8: The cartridge (1) according to clause 6, wherein the outlet (14) is an openable door, or a protective film, an end of the trigger (22) being operatively connected with the outlet (14), such that the outlet (14) is openable by the shift of the trigger (22) when the distal body (2) shifts from the rest position towards the actuation position.

Clause 9: The cartridge (1) according to any of clauses 1 to 7, wherein the compression means (10) comprise a longitudinal spring (12) arranged between the front casing (20) of the distal body (2) and a compression stop (13) of the proximal body (3), the longitudinal spring (12) being guided by means of a bolt (11) with a compression plate, and the compression stop (13) being fork-shaped with two rods for the support of the end with a blunt shape of two respective needles (6) which are arranged on each side of the compression means (10) in two respective conduits (15).

Clause 10: The cartridge (1) according to any of clauses 1 to 7, wherein the compression means (10) comprise a hinge (18) with a fixed plane integral with the proximal body (3) and a mobile plane formed by a side compression plate (17) integral with the distal body (2), a side compression spring (12) being arranged in the inner angle of the hinge (18).

Clause 11: The cartridge (1) according to any of clauses 1 to 7, wherein the compression means (10) comprise an elastic or plastic deformation material (19) which is arranged inside the distal body (2).

Clause 12: The cartridge (1) according to any of the preceding clauses, comprising several application means (6) for a reiterated application of the application means (6).

Clause 13: The cartridge (1) according to the preceding clause, wherein the several application means (6) have deformable handles (24) of electric conductor material which allow the passage of the wire (7) to join the several application means (6) to one another.

Clause 14: The cartridge (1) according to clause 1, wherein the distal body (2) is a lance which is connected at one of its ends with the proximal body (3), the lance being formed by segments (27) linked to one another, and the application means (6) being arranged in the segments (27).

Clause 15: An electric shock self-defence device (4) comprising at least one cartridge (1) according to any of the preceding clauses.

What is claimed is:

1. A cartridge for an electric shock self-defence device used to apply electric shocks to an assailant, the cartridge comprising:

a proximal body;

a distal body shiftable with respect to the proximal body and moveable between a rest position and an actuation position;

compression means arranged between the distal body and the proximal body and configured to urge the distal body towards the rest position;

a plurality of application means configured to be adhered to the assailant's body, the plurality of application means residing inside the distal body and being configured to be sequentially expelled from the distal body when the distal body is repeatedly transitioned between the rest position and the actuation position; and a wire housed in the proximal body, the wire electrically connecting the plurality of application means with the electric shock self-defence device; the proximal body configured to be mechanical and electrically coupled to the electric shock self-defence device.

2. The cartridge according claim 1, wherein each of the plurality of application means includes a handle made of an electric conductor material through which the wire passes.

3. The cartridge according to claim 2, wherein the handle is deformable for fixing the wire to each of the plurality of application means.

4. The cartridge according to claim 1, wherein the plurality of application means is arranged in a transverse stack.

5. The cartridge according to claim 4, wherein the distal body includes an outlet through which each of the plurality of application means passes when expelled from the distal body, the cartridge further comprising a spring actuated compression plate that is configured to shift each of the plurality of actuation means in a transverse direction to align each of the plurality of application means with the outlet before being expelled from the distal body.

6. The cartridge according to claim 1, wherein each of the plurality of application means includes a sharp end configured to puncture the body of the assailant.

7. The cartridge according to claim 1, wherein each of the plurality of application means is in a form of a staple.

8. The cartridge according to claim 1, further comprising drive means configured to drive each of the plurality of application means distally for the purpose of adhering each of the plurality of application means to the assailant.

9. The cartridge according to claim 8, further comprising a trigger arranged between the distal body and the proximal body, the trigger being configured to activate the drive means, upon the distal body shifting from the rest position towards the actuation position, the distal body is configured to contact the trigger to cause an activation of the drive means.

10. The cartridge according to claim 1, wherein the distal body includes an outlet through which each of the plurality of application means passes when expelled from the distal body, the outlet being closed by a door when the distal body is in an initial rest position.

11. The cartridge according to claim 1, wherein the distal body includes an outlet through which each of the plurality of application means passes when expelled from the distal body, the outlet being closed by a protective film when the distal body is in an initial rest position.

12. The cartridge according to claim 11, wherein the protective film is configured to be pierced upon a first of the plurality of application means contacting the protective film when the distal body is initially moved to the actuation position.

13. The cartridge according to claim 9, wherein the distal body includes an outlet for the passage of each of the plurality of application means, the outlet being closed by a door when the distal body is in an initial rest position, the trigger being operatively connected to the door to cause the door to open when the distal body is moved to the actuation position.

14. The cartridge according to claim 1, wherein the proximal body includes a rear casing that defines a container that stores a portion of the wire in a wound form.

15. The cartridge according to claim 1, wherein the compression means comprises a longitudinal spring arranged between a front casing of the distal body and a compression stop of the proximal body, the longitudinal spring being guided by means of a bolt, an end of the longitudinal spring acting on a compression plate of the bolt.

16. The cartridge according to claim 1, wherein the compression means comprises an elastic or plastic deformation material.

17. The cartridge according to claim 16, wherein the elastic or plastic deformation material is arranged inside the distal body.

* * * * *